United States Patent [19]

Dabbieri

[11] Patent Number: 4,613,992

[45] Date of Patent: Sep. 30, 1986

[54] 9/1 NECKTIE

[76] Inventor: Claudai L. Dabbieri, 5608 Harding Ave., Alexandria, Va. 22311

[21] Appl. No.: 737,470

[22] Filed: May 24, 1985

[51] Int. Cl.[4] ..... A42B 5/00

[52] U.S. Cl. ..... 2/144; 2/148; 2/207

[58] Field of Search ..... 2/144, 146, 148, 207, 2/91

[56] References Cited

U.S. PATENT DOCUMENTS

| | | | |
|---|---|---|---|
| D. 124,163 | 12/1940 | Berger | 2/207 X |
| D. 165,054 | 11/1951 | Crowthers | 2/207 X |
| 976,510 | 11/1910 | Siegel | 2/207 |
| 2,117,973 | 5/1938 | Miseluičz et al. | 2/91 |
| 2,270,521 | 1/1942 | Gray | 2/144 |
| 2,502,462 | 4/1950 | Kaupke | 2/146 |
| 2,942,274 | 6/1960 | Ross | 2/207 X |
| 3,733,614 | 5/1973 | Abamowitz | 2/91 X |
| 4,321,709 | 3/1982 | Steinberg | 2/91 X |

*Primary Examiner*—Louis K. Rimrodt

[57] ABSTRACT

The 9/1 Necktie is an improved invention of neckwear apparel. This improved invention is comprised of a substantially square body member and a neckband of an elongated rectangle of sufficient length to encircle the wearer's neck more than one full circle around and to encircle the wearer's neck almost but not entirely twice around. One end of the neckband is connected to the square on one of the corners of the square. The connecting seam points are located equally distanced from each side of the square.

7 Claims, 10 Drawing Figures

Figure 1
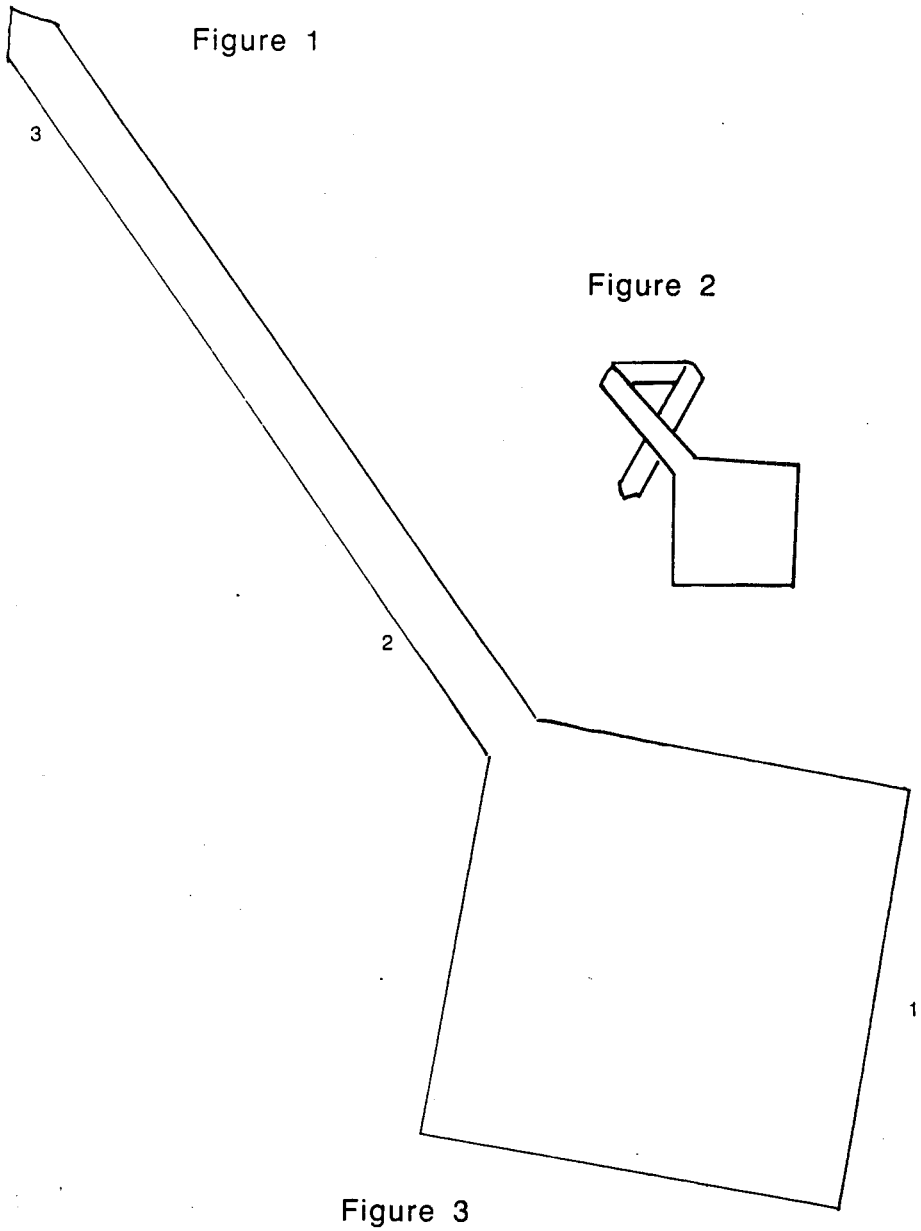
Figure 2
Figure 3
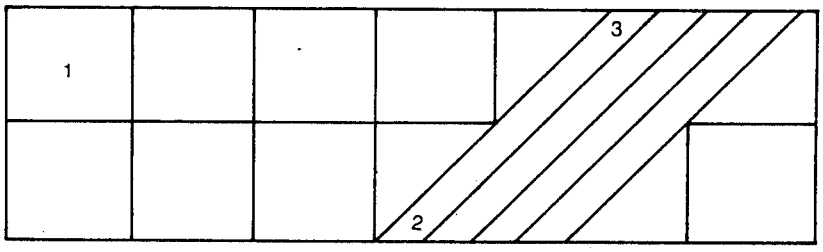

Figure 4-A
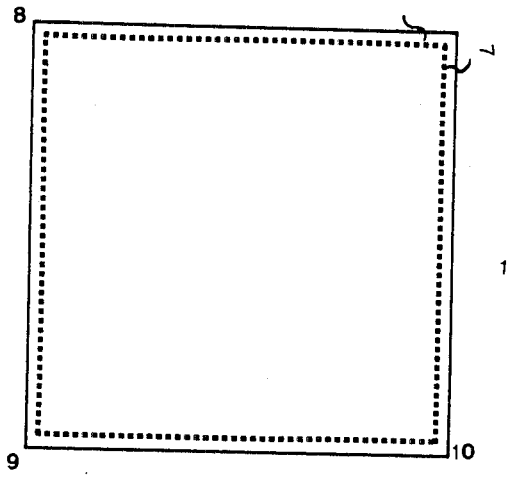
Figure 4-B
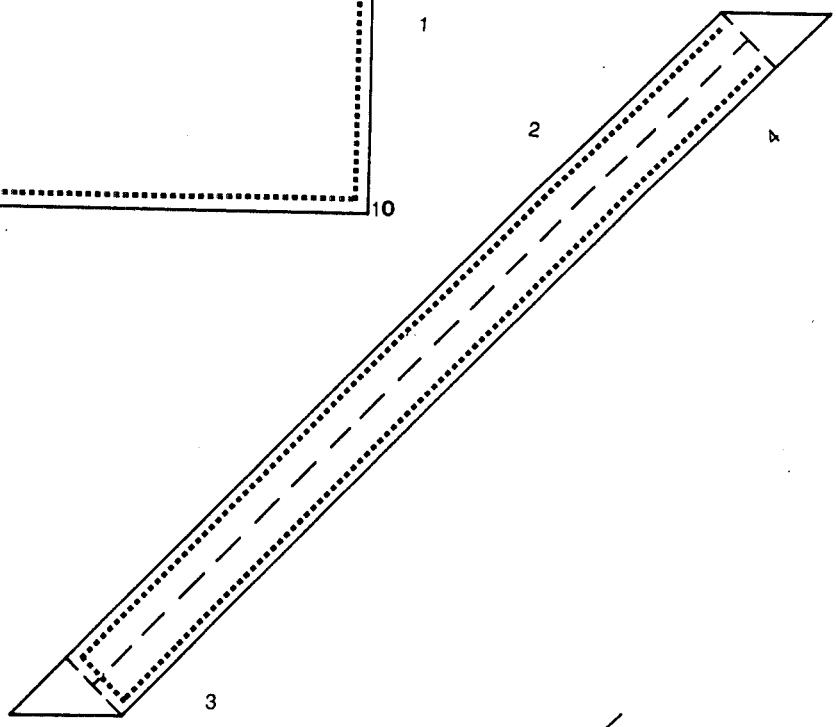
Figure 5
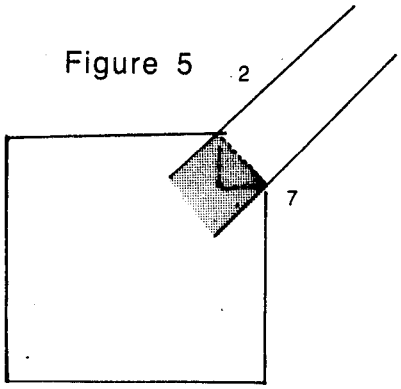

Figure 6-A
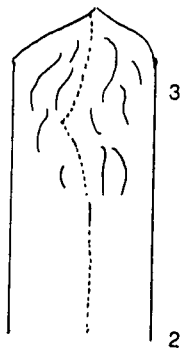
Figure 6-B
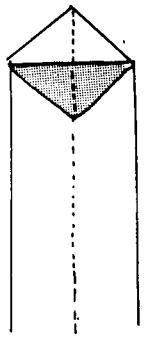

9/1 NECKTIE

BRIEF SUMMARY

The 9/1 Necktie is an improvement on prior inventions that relate specifically to neckwear apparel. The objectives of these improvements over prior inventions are:

1. To provide an innovative necktie designed especially for feminine use that does not have the styling limitations of
   1. Conventional square and rectangular scarves
   2. The M. R. Gray Neckerchief, U.S. Pat. No. 2,270,521
   3. The E. M. Ross Scarf and, U.S. Pat. No. 2,942,274
   4. The E. M. Kaupke Necktie, U.S. Pat. No. 2,502,462
2. In conjunction with the first objective the second objective of this improved invention then is to provide a necktie that may be manipulated by various means of folding, tying, twisting and knotting so as to obtain a minimum of nine different fashion styles with variations being unlimited.
3. The third objective of improvement on prior inventions is one of simplicity of design and manufacture.
4. The fourth objective of improvements over prior inventions is one of a reduced cost over prior inventions using comparably priced fabric materials.

The features of my invention that consititute significant change and improvement on prior inventions by viture of changes meeting the above stated objectives are fully described in the detailed description and drawings that follow.

BRIEF DESCRIPTION OF DRAWING

FIG. 1. is a plan view showing the 9/1 Necktie constructed in accordance with the principals of this application for an improved invention.

FIG. 2. is a view showing the necktie as it is placed around the neck as the first step to a variety of neckwear displays.

FIG. 3. shows a pattern for cutting 8 neckties on a folded piece of fabric material.

FIGS. 4*a* and 4*b*. show the 2 pattern parts and stitching path to be taken on each part.

FIG. 5. shows the 2 parts being connected by a connecting seam.

FIGS. 6*a* and 6*b* show the final step of tucking in excess fabric at the neckband ending to be pressed in place for a finished look.

FIGS. 7*a* through 10*c* show steps whereby various styles of neckwear display may be achieved with the 9/1 Necktie.

DETAILED DESCRIPTION

Figure 7:
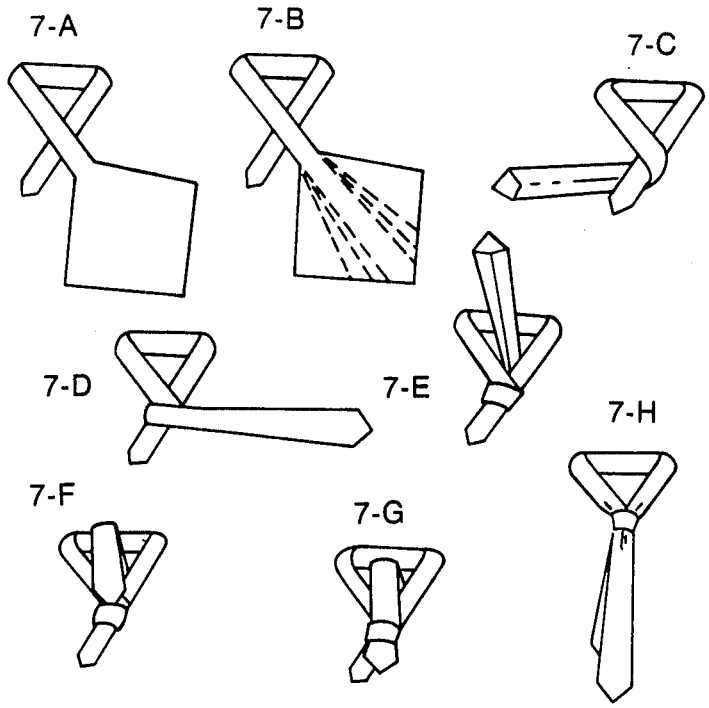

The 9/1 Necktie is an improved invention of neckwear apparel. This improved invention is comprised of a substantially square body member (1) and a neckband of an elongated rectangle of sufficient length to encircle the wearer's neck more than one full circle around (2) and to encircle the wearer's neck again but less than three times around (3). The neckband is connected (4) to the square on a corner (7) equally distanced from each side of the square (1). (8), (9) and (10) are the other three corners of the square as given in the following descriptions.

The Square may be any size from 6" sq. to 16" sq. The most optimum square for manufacturing and styling purposes seems to be 11" sq. finished. It may be composed of 1 or more layers of fabric/material.

The Neckband width dimension may range from ¼" to 4". The most optinum width dimension seems to be 1½" wide. The length dimension may range from 16" to 40". The most optimum length dimension seems to be 28"-30" finished. It may be cut on the bias or the straight of the fabric. It may be composed of 1 or more layers of fabric/material.

The front tying portion of the 9/1 Necktie is a piece of fabric/material approximately square (1) (referred to hereafter as square) even though corners may be rounded. The connection of the square to the rectangle is made on one of the corners of the square, preferrably centered on the corner thus turning the square on it's bias. See FIG. 1.

When using fine fabric my invention requires three pieces of fabric for the making of one necktie. Two squares of the same size (1) for the body member and one elongated rectangle for the neckband (2) and neckband ending (3). Part (1) is cut on the square; Part (2) and (3) are cut on the diagonal. FIG. 3 shows a pattern for cutting 8 ties. The pattern can be changed to accomodate any number of ties at a single cutting or for the length of fabric being used. There is no waste of fabric except in the triangles created between the squares (1) and the rectangles (2) and (3).

Some heavy fabrics may use only one square with a finished edge rather than two parts sewn together. Each tie uses only one neckband. Although the neckband (2 and 3) could be cut on the straight of the fabric it would not tie as well; therefore it is cut on the bias.

Square (1) and the neckband (2 and 3) are usually sewn separately before sewing them together. See FIG. 4.

Two squares (1) are sewn together, front sides of fabric facing, leaving unsewn one of the corners (7). For best results the unsewn portion should be equal distance to corner from each stopping point. This will place the square on a bias when connected with the neckband. The two squares sewn together are turned inside out so that now there is one square made of two pieces of fabric that are joined back to back.

The neckband of the necktie is of fabric/material approximately an elongated rectangular shape formed into a tube-like member.

The neckband is one piece folded together lengthwise front side facing in. Sew the long edges together sewing one end crosswise (3). (NOTE: The manufacturer's identification label is sewn into the long edge near the end of (3) during this step of the sewing process.) Turn inside out so that fabric front is now back to back.

Using the unsewn corner (7) of the square and the unsewn end (2) of the neckband with the right sides of the fabric to the outside insert unsewn edge of the neckband (2), preferrably with the seam centered, into unsewn corner (7). See FIG. 5. Turn unsewn edge of corner (7) to the inside. Top stitch (1) and (2) together through all layers of fabric. This is the connecting seam (4).

The process of connecting the square (1) with the neckband (2) may be reversed by inserting the corner point (7) into the unsewn end of the elongated rectangle without in any way altering the design of the improved invention.

Other methods of connecting the two parts together may be used, i.e., fabric adhesives, stapling, etc., however, sewing is the preferred method.

Pointed sewn edge of neckband ending (3) is made by tucking excess puckering of fabric into itself, centered, and pressing into place. See FIGS. 6*a* and 6*b*.

Other neckband endings could be used wihtout altering in anyway the styling capabilities of the tie, but this is the most stylish, and therefore preferred, neckband ending.

Tie is ready to press and wear.

Figure 8:
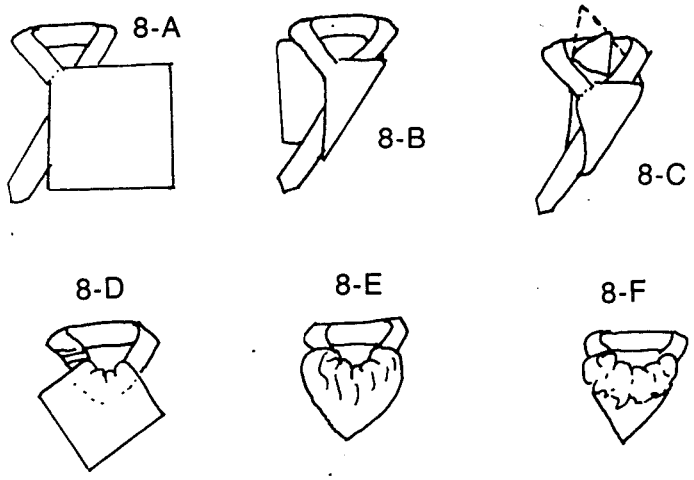
Figure 9:
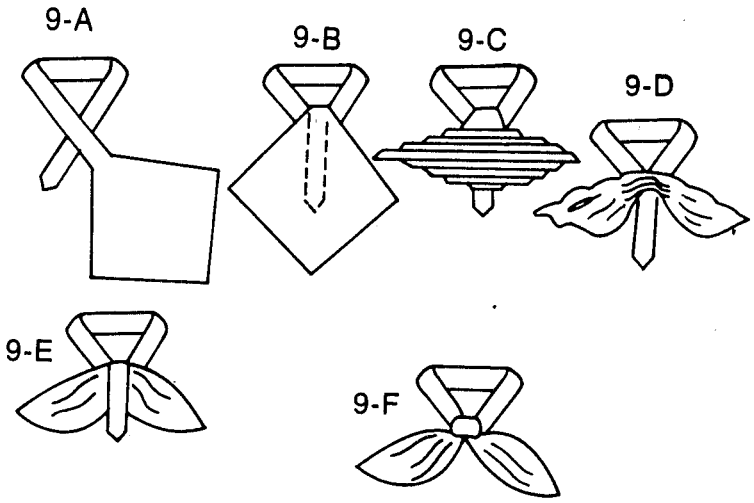
Figure 10:
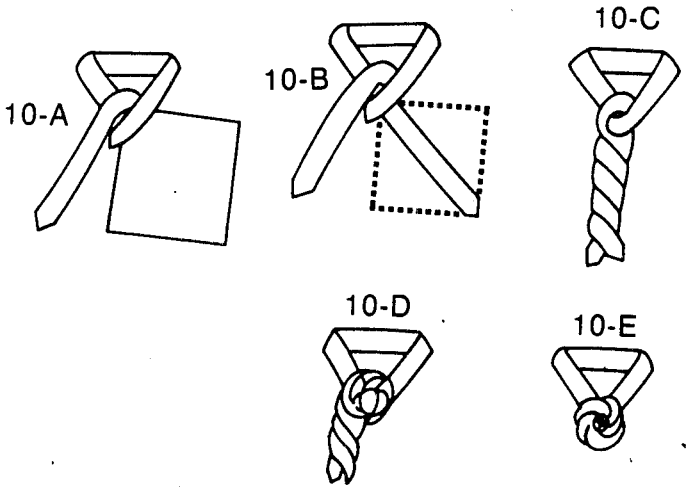

This invention as an improved invention over prior art (as in the Gray Invention, U.S. Pat. No. 2,270,521) is in the deletion of the second flap, the deletion of buttons/button holes, and the extension of the neckband of such a length to create a neckband ending. (See FIG. 2., element 3). The neckband ending (3) is not merely an extension of a neckband (2) of which the purpose is to encircle the neck and provide connection for the body members. The neckband ending (3) serves it's very own purpose and is a necessary part of the new invention. The narrow neckband goes around the neck (2) leaving the square (1) and several inches of the neckband ending (3) at the throat. (See FIG. 2). The square (1) and neckband ending (3) are tied/folded/twisted in some fashion, or manipulated together to create the various fashion styles. The ability to manipulate the square (1) and neckband ending (3) together makes this tie unique from all other ties and scarves. The narrow neckband removes a lot of unwanted bulk from around the neck but leaves enough length (4) to manipulate the styling of the square. The square (1) provides enough fabric, positioned at the appropriate location to create the various styles described (and some styles that are not described). See FIGS. 7*a*–10*c* for drawings of the tie being manipulated into various styles.

The purpose of the band in the Gray invention (U.S. Pat. No. 2,270,521) is described as being a connection for the body members. "—fastening arrangement adapts the band for engagement about necks—. In use the band is engaged about the neck and arranged so that the body members—". No other purposes for a neckband is described.

The significant changes in my invention over the Ross Scarf (U.S. Pat. No. 2,942,274) resulting in an improved invention are similar to the improvements over the Gray Neckerchief. The first change is the deletion of a body member with the remaining square body member (1) centered on a corner (7) of the square (1) being the second change. A third change would require that the body member be more substantially square than rectangular in shape. And again the most significant change is in the addition of the neckband ending (3) to the 9/1 Necktie. Although the neckband ending (3) is an extension of the neckband (2) (rather than a separate part connected) it has its own functions rather than the function of a neckband. The Ross invention has a "neckband of sufficient length to almost, but not entirely, encircle the neck of the user—". No other purpose for a neckband is described in the Ross invention.

There are no similarities of construction between the E. M. Kaupke Necktie (U.S. Pat. No. 2,502,462) and the 9/1 Necktie. The Kaupke is more commonly recognized as a necktie for masculine use whereas the 9/1 Necktie is specifically designed for feminine neckwear displays. The 9/1 improvements described are not that the 9/1 is an improved necktie for masculine wear. The improvements described are that the 9/1 Necktie is not limited in styling as is the Kaupke Necktie and that manufacturing process is much simpler. The 9/1 Necktie is able to replicate the finished look of the Kaupke Necktie in a shorter length with a variety of widths being possible (See FIG. 7*a* for detailed drawing of how this is accomplished).

To understand the unique tying capabilities of the 9/1 Necktie please see the attached drawings, FIGS. 7*a* through 10*c* for instructions for tying.

The first objective of making improvements over other scarves and neckties in terms of limitations of styling is accomplished in the following ways:

I. Conventional square and rectangular scarves, while capable of several neckwear displays, cannot in any manner be folded and knotted to replicate the look of a Necktie. The 9/1 Necktie can be tied in the traditional 4-in-hand style by following these instructions that are graphically illustrated in FIGS. 7*a*–7*h*.

1. Before placing neckband (2) around neck, fold on matching lines to your desired width see FIG. 7*a*. (8) and (10) will be folded beneath the tie square. Attach folds in place with a small safety pin on the underside or use a tie tac or broach on the top side going through all layers or press.
2. Place neckband (2) around your neck with the neckband ending (3) where you want it to end See FIG. 7*b*. All tying is done with tie square (1) and neckband (2) nearest connecting seam. Neckband end (3) remains in place See FIG. 7*b*.
3. Tie square (1) is on top of neckband end (3). Bring folded tie square (1) underneath neckband end (3) see FIG. 7*c*.
4. Double back the direction of the folded tie square (1). See FIG. 7*d*. This forms a complete loop around the neckband end (3).
5. Bring folded tie square (1) underneath neckband (2) with (9) in an upwards direction. See FIG. 7*e*.
6. About midway of the folded tie square (1) bend the tie square downwards. See FIG. 7*f*. Place (9) into the loop created by the wrapping of tie square. See FIG. 7*g*.
7. Pull (9) until the entire folded tie square comes through the loop. The connecting seam (4) should be covered by this loop. See FIG. 7*g*.
8. Tighten the tie by holding the knot with one hand and pulling on the neckband end (3) with the other. Loosen the tie by holding the knot and pulling on the neckband (2) or tie square (1) just above the knot. See FIG. 7*h*.

II. The M. R. Gray Neckerchief (U.S. Pat. No. 2,270,521) cannot be worn in any fashion other than the single styling for which it was invented without changes being made to the invention.

The 9/1 Necktie, while not being limited to this style, is able to replicate this style by following these instructions that are graphically illustrated in FIGS. 8*a*–8*f*.

1. Place Neckband (2) around the neck with tie square (1) very high at neckline. See FIG. 8*a*.
   a. Tie square (1) should be on top of the neckband end (3) for the ascot.
   b. Neckband end (3) should be on top for the jabbot.
2. Loop tie square (1). See FIG. 8*b*.
   a. Under and over the neckband end (3) for the ascot
   b. Over and under the neckband end (3) for the jabbot.
3. This forms a very wide loose slip knot. See FIG. 8*c*.
4. Wrap neckband end (3) around neckband (2) a second time and tuck the last 1" to secure. See FIG. 8*d*.
5. Repeat step 2 in a very loose way. Points (9) and (10) should be positioned on shoulders.

6. Spread tie square (1) for desired effect. This tie will stay in place better if points (9) and (10) are pinned in place (beneath the blouse or to bra straps). See FIGS. 8*e* and 8*f*.

III. The E. M. Ross scarf (U.S. Pat. No. 2,942,274) while capable of numerous neckwear displays is not capable of replicating the 4-in-hand, Windsor, Half-Windsor or any variations of styling derived thereof.

A Bow similar to FIG. 3 of the E. M. Ross drawing can easily be replicated in styling with the 9/1 Necktie by following these instructions that are graphically illustrated in FIGS. 9*a*–9*f*.

1. Place neckband (2) around the neck. Connecting seam (4) should be located where you would like for the knot to be when bow is completed. See FIG. 9*a*.
2. Make a slip knot. Point (9) should drop straight down from the neck with the neckband end (3) directly on top of it. See FIG. 9*b*.
3. Beginning at point (9) make small accordian pleates all the way up to the slip knot at connecting seam (4). See FIGS. 9*c* and 9*d*.
4. Wrap the neckband end (3) around the pleats gathered at (4). Continue to wrap until only ½"–1" of neckband end (3) remains. See FIG. 9*e*.
5. Tuck neckband end (3) underneath a couple layers of wrapping to secure the bow. See FIG. 9*f*.

VI. The E. M. Kaupke Necktie (U.S. Pat. No. 2,502,462) is limited entirely to the very styles that the E. M. Ross Scarf is incapable of replicating, i.e., a 4-in-hand, Short 4, Windsor or half-Windsor. As described above the 9/1 Necktie is capable of replicating the 4-in-hand. With simple variations on the folding and tying the 9/1 Necktie can replicate any style that can be tied from a Kaupke Necktie. Unlike the Kaupke, the 9/1 is not limited to 4-in-hand variations but as already described can tie Bows and Ascots. In addition to these styles the 9/1 can also tie a Rosette by following the instructions that are graphically illustrated in FIGS. 10*a*–10*e*.

1. Place neckband (2) around neck. Slip knot at connecting seam (4). See FIG. 10*a*.
2. Place neckband end (3) in center of tie square. See FIG. 10*b*.
3. Roll points (8) and (10) towards center of tie square. Neckband end (3) is now inside rolled tie square (1). See FIG. 10*c*.
4. Twist rolled tie square until it begins to buckle. See FIG. 10*c*.
5. The buckled twist will begin to make a circle around the slip knot. There will be a hole in the middle of the circle. See FIG. 10*d*.
6. Working from the center, wind around to the back of the circle as the circle repeats until only 1" of rolled tie square remains. See FIG. 10*d*.
7. Coming from the back tuck the ends into the hole formed in the center. Do not pull ends all the way through the hole. See FIG. 10*e*.

The improvement over the Ross Scarf in this particular style is that twice as much fabric in the body squares is going to make a large Rosette that is much too bulky for comfortable wearing. Not only would this also be true of the Ross Neckerchief but the tabs and buttons would not lend themselves at all well to forming the center of the Rosette which is necessary to securing this style in place.

The 9/1 Necktie is capable of tying styles replicating all of the styles that can be tied from (1) the conventional scraves, (2) the M. R. Gray Neckerchief, (3) the E. M. Ross Scarf and (4) the E. M. Kaupke Necktie without the limitations that each of those 4 constructions of Neckwear now have.

In order to meet the second objective the 9/1 Necktie is specifically designed to overcome the limitations of the above 4 articles of neckwear in that it is capable of tying NINE styles. These nine styles include but are not limited to the following:

1. Traditional 4-in-hand;
2. Short 4, a variation of the 4-in-hand that is knotted several inches below the neckline and the tie front is much shorter than the tie front of the 4-in-hand;
3. Le-Scarf, a style that replicates conventional square scarves;
4. Rosette a style more commonly made in a "finished" form or styled by twisting and tying conventional rectangular scarves;
5. Florette, again a style commonly manipulated from conventional rectangular scarves;
6. Bow Tie, a style most nearly replicating the E. M. Ross Scarf;
7. Small Bow Tie, again a style replicating either the E. M. Ross Scarf or a bow made from a conventional scarf but on a smaller scale;
8. The Flapper Bow, a style of bow commonly made from small conventional square scarves;
9. Ascot/Jabbot, styles replicating the M. R. Gray Neckerchief.

Multiple variations on each of these styles are possible. It would be impossible to determine exactly how many in that even the slightest variation in a knot, a fold or a twist can change the styling significantly.

The third objective, simplicity of design and manufacture, is accomplished by making use of the simplest design possible. Specifically, this improved design:

1. Uses only the amount of fabric essential to meet the first 2 objectives;
2. Keeps the steps in the labor process to fewer than the steps required by the three patents referenced;
3. Makes use of fewer parts than the three aforementioned patents;
4. Requires fewer linear inches of stitching than the three cited patents and;
5. Streamlines the cutting process whereby labor is further reduced and waste of fabric is kept to a minimum of unuseable scraps.

In making comparisons between the 9/1 Necktie and the three referenced patents each of the above examples of improvement will be more fully explained by the following chart.

| IMPROVEMENT COMPARISONS | |
|---|---|
| 9/1 Necktie | Gray Ross Kaupke |
| 1. Uses minimal fabric, 1 double sided flap and 1 neckband (See FIGS. 1 and 4) | 1. Gray and Ross require two flaps of double sided fabric; Kaupke requires 2 elongated cuniform sections as well as a lining. |
| 2. Six steps: | 2. In addition to the 6 steps described |
| 1. lay fabric and pattern | in the 9/1 process the Gray patent |

-continued

| IMPROVEMENT COMPARISONS | |
|---|---|
| 9/1 Necktie | Gray Ross Kaupke |
| 2. cut<br>3. sew square, 1 continuous seam<br>4. sew neckband, 1 continuous seam<br>5. Sew neckband and square together<br>6. Press<br>(See FIGS. 3–6) | requires sewing of 1 additional square plus sewing on 2 buttons and 2 button holes. Ross patent requires an additional square plus double seaming of the neckband. The steps in Kaupke are rather numerous as this article requires much folding during the sewing process and has a lining as well. |
| 3. Only 2 parts, a square and a neckband (See FIGS. 4–5) | 3. Gray requires 3 parts, Ross requires 3 parts and Kaupke requires 4 (2 outer parts plus 2 parts for the lining). |
| 4. Linear inches of stitching minimum (approx. 60") (See FIGS. 4–5) | 4. Gray requires double, Ross and Kaupke requires triple. |
| 5. Cutting - ratio of square to neckband and uniformity of parts allows for edge to edge cutting of parts with only scrap waste. (See FIG. 3) | 5. Gray and Ross requires additional cutting per tie because of the additional flap. Kaupke parts cannot be cut edge to edge because of the differences in sizes of the parts. Also requires additional cutting for lining. |

The fourth objective, reduction of cost, is also met by meeting the conditions as set forth in the third objective. Using comparibly priced materials the 9/1 Necktie cost less to manufacture and is therefore an improvement on prior inventions because:

1. Requires less fabric, therefore more end product for the same amount of yardage/dollars.
2. Less waste means more end product for the same amount of yardage/dollars.
3. Requires less labor, labor takes time and laborers on a clock longer cost more money per end product.

What is claimed is:

1. An article of neckware comprising an elongated rectangle neckband cut on the diagonal and formed into a tube-like member, a body member cut on the square having at least one corner point, said body member being attached together at said corner point with said tube-like member being of sufficient length to encircle the neck of a wearer more than once, said neckband tube-like member being cooperable with the body member whereby the members may be fastened around the neck of a wearer and formed into a folded, twisted and/or knotted ornamental design.

2. The article of claim 1 wherein the ornamental design is in the form of a traditional necktie.

3. The article of claim 1 wherein the ornamental design is in the form of a rosette.

4. The article of claim 1 wherein the design is in the form of an ascot.

5. The article of claim 1 wherein the design is in the form of a bow tie.

6. The article of claim 1 wherein said body member is formed of two parts of the same size, joined together, back to back.

7. The article of claim 6 wherein the tube-like neckband member is inserted into said body member at said corner point before joining the two members together.

* * * * *